US007070066B2

(12) United States Patent
Strong et al.

(10) Patent No.: US 7,070,066 B2
(45) Date of Patent: Jul. 4, 2006

(54) LIQUID DISPENSING VALVE AND METHOD WITH IMPROVED STROKE LENGTH CALIBRATION AND FLUID FITTINGS

(75) Inventors: Warren N. Strong, Coventry, RI (US); Michael A. Vidal, North Attleborough, MA (US)

(73) Assignee: Nordson Corporation, Westlake, OH (US)

( * ) Notice: Subject to any disclaimer, the term of this patent is extended or adjusted under 35 U.S.C. 154(b) by 6 days.

(21) Appl. No.: 10/820,278

(22) Filed: Apr. 8, 2004

(65) Prior Publication Data

US 2005/0224513 A1 Oct. 13, 2005

(51) Int. Cl.
*B67D 5/22* (2006.01)

(52) U.S. Cl. ..... 222/31; 222/32; 222/287; 222/504

(58) Field of Classification Search ..... 222/31, 222/32, 282, 283, 287, 504
See application file for complete search history.

(56) References Cited

U.S. PATENT DOCUMENTS

| | | | | |
|---|---|---|---|---|
| 2,401,503 A | | 6/1946 | Paasche | |
| 2,929,566 A | | 3/1960 | Paasche | |
| 3,066,874 A | | 12/1962 | Becker | |
| 3,168,250 A | | 2/1965 | Paasche | |
| 3,366,288 A | * | 1/1968 | Goldschein | 222/504 |
| 3,814,328 A | | 6/1974 | Warning | 239/411 |
| 5,467,899 A | * | 11/1995 | Miller | 222/309 |
| 6,314,987 B1 | | 11/2001 | Hay | 137/241 |

FOREIGN PATENT DOCUMENTS

WO 03/O24608 3/2003

OTHER PUBLICATIONS

TEK, *Pharmaceutical and Bio-Tech Fittings,* Brochure, 3 pgs., undated.
BBS-Systems AG, *General Specification for BBS-Systems Components,* 13 pgs., Feb. 24, 2003.
DuPont Dow Elastomers, *Kalrez® Sanitary Seals,* Brochure, 2 pgs., Mar. 2003.
Goran Anderberg, *Design of Mechanical Seals for Hygienic and Aseptic Applications,* 8 pgs., undated.
International Dispensing Corporation, *NSF Certifies International Dispensing Corporation (OTCBB-IDND) Aseptic Gravity Flow Valve,* Press Release, 2 pgs. undated.
ROM Stuttgart, *How to Choose an Aseptic Valve*, Article, Business Briefing: Life Sciences Technology, 4 pgs., undated.
Huub L.M. Lelieveld, *The EHEDG Certification Scheme,* Article, 4 pgs., undated.

(Continued)

*Primary Examiner*—Joseph A. Kaufman
(74) *Attorney, Agent, or Firm*—Wood, Herron & Evans, L.L.P.

(57) ABSTRACT

A liquid dispensing valve includes a valve body, a valve seat, and a reciprocating valve member engageable with the valve seat for controlling flow through a liquid outlet. A calibration device includes a rotatable stroke control stop member and a rotatable reference ring. The reference ring and stop member may be initially rotated to a zero position and, subsequently, the stop member may be rotated to set the desired stroke length. One or more fluid fittings are provided and sealed against the valve body using a clamp plate.

12 Claims, 3 Drawing Sheets

OTHER PUBLICATIONS

Crane Process Flow Technologies Ltd., *Biopharm Solutions,* Website, 2 pgs., undated.
Tuchenhagen North America, *Stericom® Aseptic Valves,* Brochure, 4 pgs., undated.
Burkert Fluid Control Systems, *Miniature Rocker Solenoid Valve,* Brochure, 4 pgs., Aug. 2002.
European Patent Office, *International Search Report and Written Opinion in PCT/US2005/011721,* Nov. 15, 2005, 15 pgs.

* cited by examiner

LIQUID DISPENSING VALVE AND METHOD WITH IMPROVED STROKE LENGTH CALIBRATION AND FLUID FITTINGS

FIELD OF THE INVENTION

The present invention generally relates to fluid dispensing devices and methods related to dispensing liquids with or without process air assistance and, more specifically, to adjusting liquid flow through the liquid outlet and making connections to the air and liquid passages within the valve.

BACKGROUND OF THE INVENTION

Liquid dispensing valves of the type associated with the present invention generally provide for the selective flow of fluid, such as liquid with or without process air, through a valve body and then out of a nozzle orifice or liquid outlet. The process air may impart some characteristic to the liquid discharging from the nozzle orifice, such as swirling or otherwise moving a liquid filament, or atomizing the liquid as it is discharged. Control of the flow through the nozzle orifice is typically effected by reciprocating a valve member along a stroke length. The valve member ordinarily seats against a valve seat member which includes the nozzle orifice. Movement of the valve member away from the valve seat permits liquid to flow out through the orifice at a rate commensurate with the gap between the valve and the valve seat. Movement of the valve member against the valve seat prevents liquid flow through the nozzle orifice.

Various manners of accurately controlling flow of liquid through the nozzle orifice have been proposed in the past and are in practice today. For example, the size of the nozzle orifice itself may be changed by changing from one nozzle to another. However, nozzle changes are time consuming and require increased inventory of parts. Other methods involve changing the stroke length of the valve member so as to change the gap between the valve member and the valve seat when the valve member is in the open position. In the past, such stroke length adjustment mechanisms have had various drawbacks, for example, related to complexity of use and design, and repeatability of proper adjustments.

The fluid fittings used in typical liquid dispensing valves often use threads for connecting the fittings to the valve body. Unfortunately, threading a fluid fitting into place can result in inconsistent seal compression from one valve to another and this can result in leakage. Also, threaded fittings may be prone to the formation of cavities in which liquid stagnation may occur and this can be a problem especially in applications requiring aseptic conditions. Finally, threaded fittings may not be as easily modified to connect, for example, to a wide variety of push-on type flexible tubing, and may not be easily cleaned as may be necessary for certain applications, including aseptic applications.

For at least the reasons set forth above, it would be desirable to provide a liquid dispensing valve in which the stroke length is easily calibrated and set, and which provides improved fluid connections overcoming the drawbacks associated with the prior art.

SUMMARY OF THE INVENTION

The present invention provides a liquid dispensing valve generally including a valve body, a valve seat, a valve member, and a calibration device coupled with the valve member. The valve body includes a liquid inlet, a liquid outlet, and an interior liquid chamber in communication with the liquid inlet and the liquid outlet. The valve seat, which is positioned in the valve body, receives the valve member for selective engagement. The valve member is mounted for reciprocating movement between a closed position engaged with the valve seat and an open position disengaged from the valve seat. The calibration device includes a rotatable reference ring having a first zero reference indicator and additional indicia thereon for indicating incremental increases in stroke length of the valve member. The calibration device further includes a rotatable stroke control stop member having a second zero reference indicator. The stop member is capable of being rotated to change the stroke length of the valve member between zero and a maximum stroke length. The first and second zero reference indicators may be aligned after the stroke control stop member has been adjusted to set the stroke length at zero. Thereafter, the rotatable stroke control stop member may be rotated relative to the reference ring to set the desired stroke length between zero and the maximum stroke length.

A method of calibrating the stroke length of a liquid dispensing valve, generally as described above, includes rotating the stroke control stop member into operative engagement with the valve member in the closed position to prevent movement of the valve member toward the open position. The reference ring is then rotated to align its zero stroke length reference indicator with the zero stroke length reference indicator on the stroke control stop member. The stroke control stop member is then rotated out of engagement with the valve member such that the stroke length reference indicator on the stroke control stop member aligns with a desired one of the plurality of stroke reference indicators on the stroke reference ring to set and indicate the stroke length of the valve member.

In another aspect of the invention, a liquid dispensing valve includes a valve body, a valve seat, and a reciprocating valve member generally as described above. A first fluid fitting having a first sealing portion and a first connecting portion is positioned to be in fluid communication with the liquid inlet of the valve body. A first seal is positioned between the valve body and the first fluid fitting. A clamp plate is removably secured to the valve body and clamps the first sealing portion of the first fluid fitting against the first seal with the first connecting portion adapted to coupled with a liquid conduit. Preferably, the dispensing valve includes a second similar fluid fitting for communicating with a process air inlet of the valve body. The second fluid fitting is clamped against a second seal by using the clamp plate.

Various objectives, advantages and additional features of the invention will become more readily apparent to those of ordinary skill in the art upon review of the following detailed description of the illustrative embodiment, taken in conjunction with the accompanying drawings.

DETAILED DESCRIPTION

Figure 1:
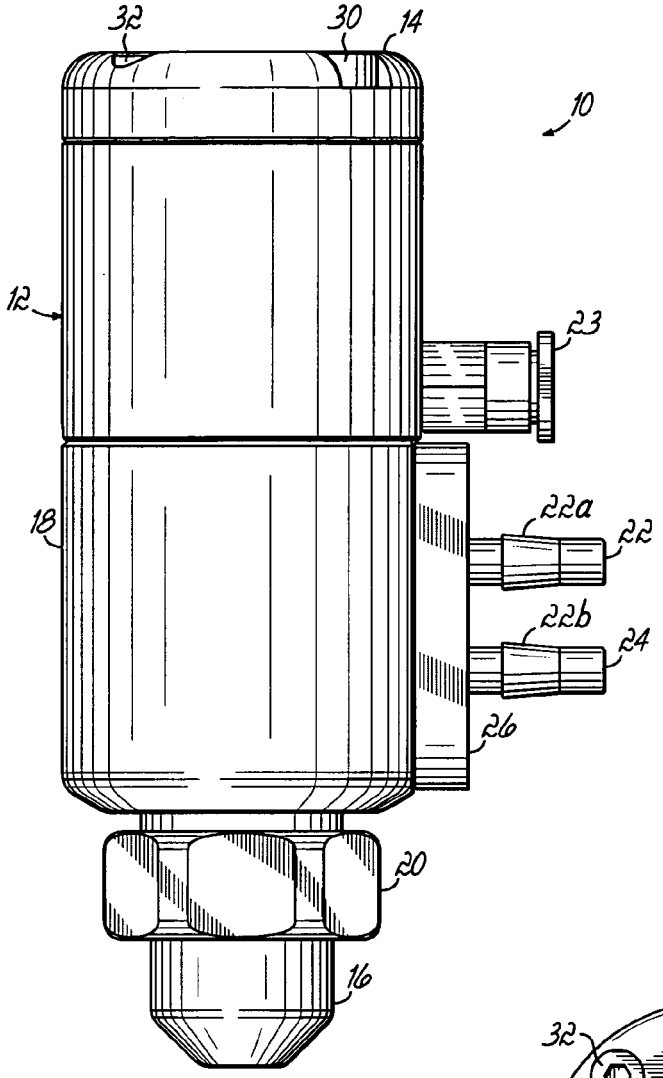
FIG. 1 is a side elevational view of a liquid dispensing valve constructed in accordance with a preferred embodiment of the invention.
Figure 4:
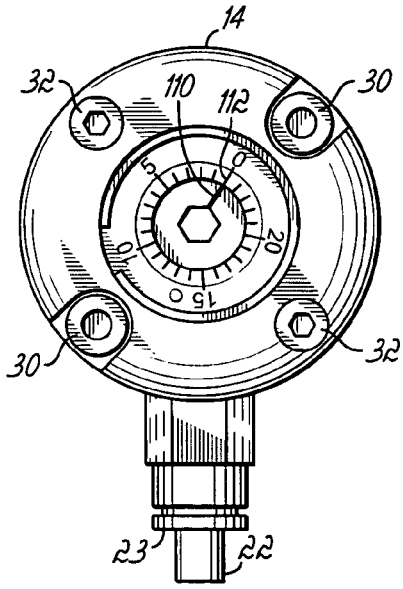
FIG. 4 is a top view of the dispensing valve.

Referring to FIG. 1, one illustrative example of the invention is embodied in a liquid dispensing valve 10 having a valve body 12 generally comprising a cap 14 at an upper end, a nozzle 16 at a lower end, and a central body portion 18. Nozzle 16 may be retained on central body portion 18 by a threaded nut 20. Fluid fittings 22, 24 are provided for respectively supplying liquid and process air to valve body 18. In the preferred embodiment, fittings 22, 24 include barbed portions 22*a*, 24*a* which receive push-on type flexible conduits, such as silicone tubing. Another fluid fitting 23 is used to supply actuation air as will also be discussed below. Fluid fittings 22, 24 are retained on valve body 18 by a clamp plate 26 in a manner to be described further below. Cap 14 is retained on central body portion 18 by, for example, cap screws 30, 32 (FIG. 4).

Figure 2:
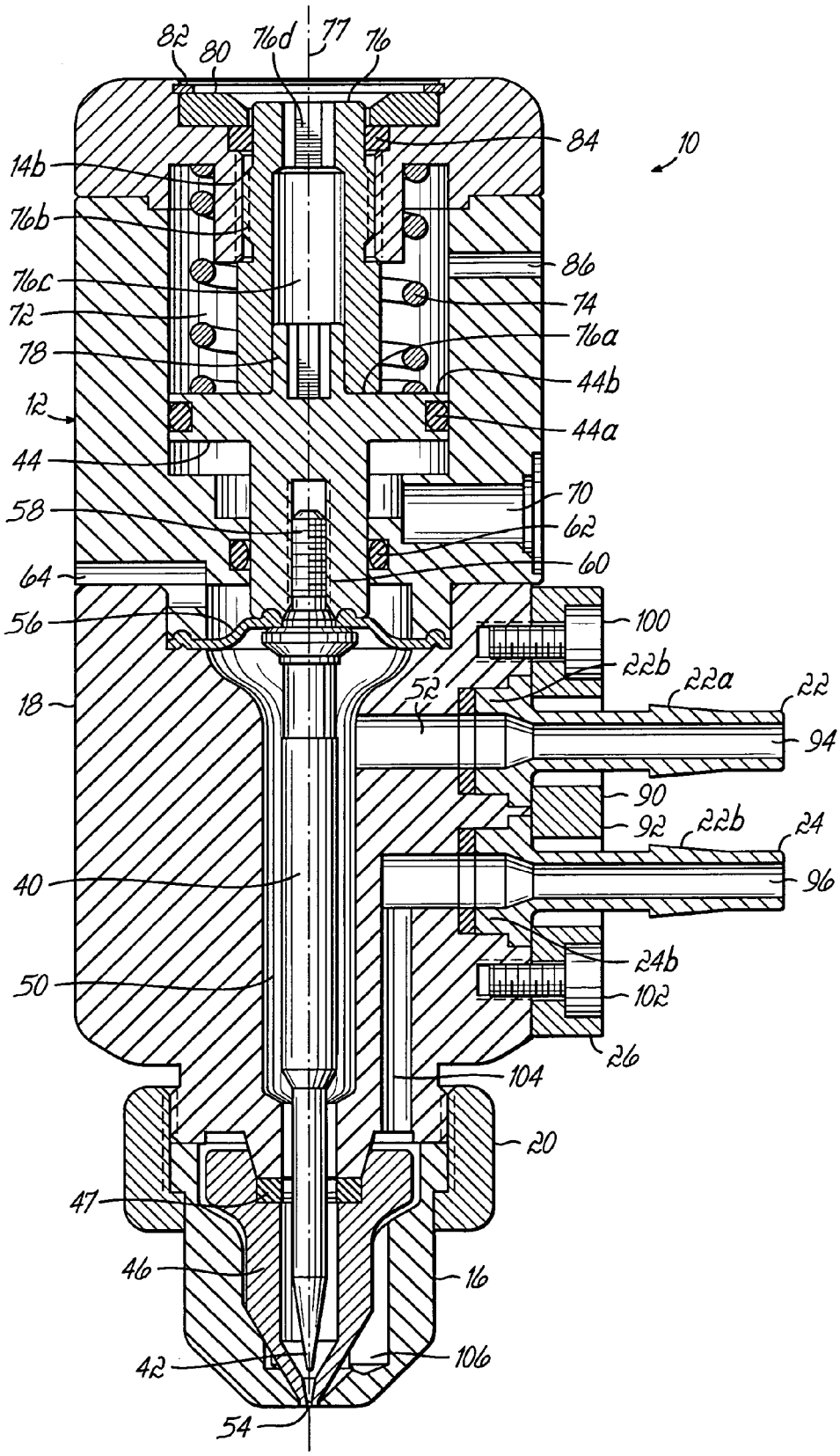
FIG. 2 is an axial cross sectional view of the dispensing valve shown in FIG. 1 with the valve member in the open position.
Figure 3:
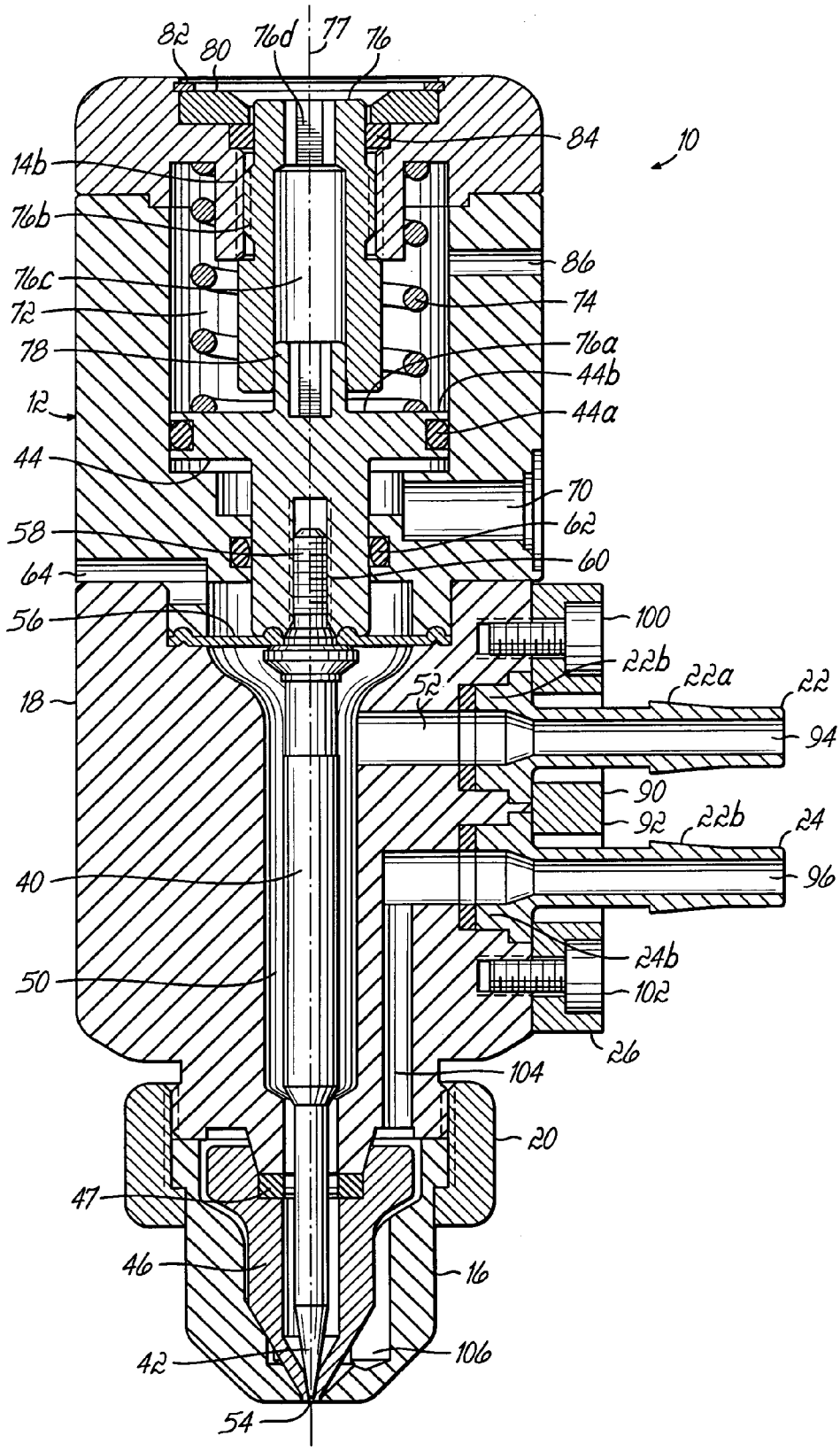
FIG. 3 is a cross sectional view similar to FIG. 2, but illustrating the valve member in the closed position.

Referring now to FIGS. 2 and 3, which respectively show the open and closed positions of dispensing valve 10, a reciprocating valve member 40 is used to selectively allow and prevent the flow of liquid through the valve 10. Valve member 40 includes a needle portion 42 at one end and a piston 44 at an opposite end. Needle portion 42 preferably resides within a valve seat 46 and, more generally, within a portion of a liquid chamber 50 which extends essentially between a liquid supply passage 52 in central body portion 18 and a liquid outlet or orifice 54 in valve seat 46. An O-ring 47 provides a seal between central body portion 18 and valve seat 46. A diaphragm-type seal member 56 is secured to central body portion 18 and to valve member 40 to prevent liquid from leaking into the upper actuation portion of valve 10 or contaminants from entering liquid chamber 50 from the actuation portion of the valve 10. A threaded portion 58 of valve member 40 connects to a threaded portion 60 of piston 44 retaining diaphragm 56 therebetween. An O-ring 62 also provides a dynamic seal around the lower portion of piston 44. A vent 64 is provided to allow air to escape as the diaphragm 56 moves upward from the closed position shown in FIG. 3 to the open position shown in FIG. 2 and to allow introduction of air when diaphragm 56 moves downward.

To move the valve member 40 to the open position shown in FIG. 2, actuation air is introduced into air supply passage 70 and piston chamber 72 thereby moving piston 44 upward against the force of a compression coil spring 74 until the upper side of piston 44 contacts a rotatable stroke control stop member 76 and, more specifically, a lower edge 76*a* thereof. An externally threaded portion 76*b* of stop member 76 is engaged with an internally threaded portion 14*b* of cap 14. This allows stop member 76 to be rotated, and thereby translated or moved, upward or downward relative to cap 14 and piston 44. This adjusts the location of the lower edge 76*a* and, likewise, the upper end of the stroke length for piston 44 and valve member 40. An upwardly projecting portion 78 of piston 44 is received in a central hollow section 76*c* of stop member 76. Rotational and translational movement respectively around and along axis 77 is allowed by the interaction between stop member 76 and projecting portion 78. A rotatable reference ring 80 is affixed to cap 14 by a retaining ring 82 such that reference ring 80 may rotate around the upper end of stop member 76. An O-ring 84 is positioned within cap 14 so as to engage both the stop member 76 and reference ring 80. This provides a sealing function and also supplies friction to stop member 76 and reference ring 80 to assist with holding these items in their desired positions relative to each other when the stroke length is set. A vent 86 is provided in central body portion 18 to communicate with piston chamber 72 above piston 44 thereby allowing the escape of air as the piston 44 moves to the upper or open position shown in FIG. 2 and introduction of air as piston 44 moves to the lower or closed position shown in FIG. 3.

As further shown in FIGS. 2 and 3, fluid fittings 22, 24 include sealing portions 22*b*, 24*b* which engage respective O-ring seals or gaskets 90, 92 when respective liquid and process air supply passages 94, 96 in fluid fittings 22, 24 align with respective liquid and process air supply passages 52, 98 in central body portion 18 and clamp plate 26 has been secured in place using fasteners 100, 102. Process air passage 98 communicates with respective additional air passages 104, 106 designed, in this example, to discharge pressurized process air proximate liquid outlet 54 thereby atomizing the discharged liquid. It will be understood that many different types of dispensing valves may incorporate the features of the present invention including with or without the use of process air designed to impart any desirable characteristics to the discharged liquid.

To calibrate and set the stroke length of reciprocating motion for valve member 40 along axis 77, valve member 40 is initially moved to the closed position shown in FIG. 3. Rotatable stroke control stop member 76 is then rotated clockwise to move lower edge downward (as viewed in FIG. 3) until lower edge 76*a* contacts upper surface 44*b* of piston 44. This may be accomplished using a suitable tool (not shown) inserted into a complementary recess 76*d* in stop member 76. The tool may be specialized or unique to help prevent unwanted tampering. In this position, a "zero" stroke length is set since the stop member 76 will prevent any upward travel of valve member 40. Referring to FIG. 4, reference ring 80 is then rotated until the zero indicator 112 aligns with the stroke reference indicator 110 thereby indicating the zero stroke length position of rotatable stop member 76. To then set the desired stroke length, the rotatable stop member 76 is rotated in a counterclockwise direction using the hash marks on reference ring 80 as stroke length indicators until the desired stroke length is set. In this example, each hash mark represents 0.001 inches of stroke length. Therefore, if indicator 110 is rotated to align with the hash mark labeled "10" this would indicate a stroke length of 0.01 inches. Of course, other stroke length increments may be used instead by, for example, changing the thread pitch on stop member 76 and cap 14.

While the present invention has been illustrated by a description of a preferred embodiment and while this embodiment has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

However, the invention itself should only be defined by the appended claims, wherein we claim:

1. A liquid dispensing valve comprising:

a valve body having a liquid inlet, a liquid outlet, an interior liquid chamber in communication with said liquid inlet and said liquid outlet;

a valve seat positioned in said valve body;

a valve member mounted for reciprocating movement in said liquid chamber between a closed position engaged with said valve seat to prevent liquid from exiting through said liquid outlet and an open position disengaged from said valve seat to allow liquid to flow through said liquid outlet;

a calibration device coupled with said valve member comprising a rotatable reference ring having a first zero reference indicator and additional indicia thereon for indicating incremental increases in stroke length of said valve member, and a rotatable stroke control stop member having a second zero reference indicator and capable of being rotated to change the stroke length of said valve member between zero and a maximum stroke length, wherein said first and second zero reference indicators are aligned to indicate a zero reference after said stroke control stop member has been adjusted to set the stroke length at zero and, thereafter, said rotatable stroke control stop member is rotated relative to said reference ring to set the desired stroke length between zero and the maximum stroke length.

2. The dispensing valve of claim 1, further comprising:

a piston coupled for reciprocating movement with said valve member, said piston having first and second sides, said first side stopping against said stroke control stop member when said valve member is in the open position and an air chamber positioned on said second side for receiving pressurized actuation air operative to move said piston and said valve member to the open position.

3. The dispensing valve of claim 2, further comprising:

a compression spring acting on said first side of said piston and capable of moving said piston and said valve member to the closed position upon exhaustion of the pressurized actuation air from said chamber.

4. The dispensing valve of claim 3, wherein said stroke control stop member is positioned within said compression spring.

5. The dispensing valve of claim 1, further comprising:

a frictional member positioned in engagement with said reference ring and said stroke control stop member and operative to prevent inadvertent further rotation of said reference ring and said stroke control stop member after setting the zero reference point and the desired stroke length.

6. The dispensing valve of claim 5, wherein said frictional member further comprises an O-ring.

7. A liquid dispensing valve comprising:

a valve body having a liquid inlet, a liquid outlet, an interior liquid chamber in communication with said liquid inlet and said liquid outlet;

a valve seat positioned in said valve body;

a valve member mounted for reciprocating movement in said liquid chamber between a closed position engaged with said valve seat to prevent liquid from exiting through said liquid outlet and an open position disengaged from said valve seat to allow liquid to flow through said liquid outlet;

a calibration device coupled with said valve member comprising a rotatable reference ring having a first zero reference indicator and additional indicia thereon for indicating incremental increases in stroke length of said valve member, and a rotatable stroke control stop member having a second zero reference indicator and capable of being rotated to change the stroke length of said valve member between zero and a maximum stroke length, wherein said first and second zero reference indicators may be aligned after said stroke control stop member has been adjusted to set the stroke length at zero and, thereafter, said rotatable stroke control stop member may be rotated relative to said reference ring to set the desired stroke length between zero and the maximum stroke length, a first fluid fitting having a first sealing portion and a first connecting portion, said first fluid fitting positioned in fluid communication with said liquid inlet;

a first seal positioned between said valve body and said first fluid fitting; and a clamp plate removably secured to said valve body and clamping said first sealing portion of said first fluid fitting against said first seal with said first connecting portion adapted to couple with a liquid conduit.

8. The liquid dispensing valve of claim 7, wherein said first connecting portion further comprises a first barbed portion for coupling with a flexible liquid conduit.

9. The liquid dispensing valve of claim 7, wherein said valve body further comprises a process air inlet for directing air to a location proximate said liquid outlet, and further comprising:

a second fluid fitting having a second sealing portion and a second connecting portion, said second fluid fitting positioned in fluid communication with said process air inlet; and a second seal positioned between said valve body and said second fluid fitting, said clamp plate clamping said second sealing portion of said second fluid fitting against said second seal with said second connecting portion adapted to couple with an air conduit.

10. The liquid dispensing valve of claim 9, wherein said second connecting portion further comprises a second barbed portion for coupling with a flexible air conduit.

11. A method of calibrating the stroke length of a liquid dispensing valve which comprises a valve member movable along a stroke length between open and closed positions and a calibration device operative to set the stroke length, the calibration device having a rotatable stroke control stop member with a stroke length reference indicator thereon and a rotatable reference ring with a plurality of stroke length reference indicators thereon, the method comprising:

rotating the stroke control stop member into operative engagement with the valve member in the closed position thereby preventing movement of the valve member toward the open position;

rotating the reference ring to align its zero stroke length reference indicator with the zero stroke length reference indicator on the stroke control stop member; and rotating the stroke control stop member out of engagement with the valve member such that the stroke length reference indicator on the stroke control stop member aligns with a desired one of the plurality of stroke reference indicators on the stroke reference ring to set and indicate the stroke length of the valve member.

12. The method of claim 11, wherein the valve member further comprises a piston coupled to a valve stem, and the steps of rotating the stroke control stop member respectively further comprise rotating the valve member into and out of engagement with the piston.

* * * * *